US008967968B2

(12) United States Patent
Umehara et al.

(10) Patent No.: US 8,967,968 B2
(45) Date of Patent: Mar. 3, 2015

(54) TURBINE ROTOR BLADE

(75) Inventors: Takeshi Umehara, Tokyo (JP); Osamu Ueda, Tokyo (JP); Koji Watanabe, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/362,755

(22) Filed: Jan. 31, 2012

(65) Prior Publication Data

US 2012/0315150 A1 Dec. 13, 2012

(30) Foreign Application Priority Data

Jun. 9, 2011 (JP) ..... 2011-128958

(51) Int. Cl.
*F01D 5/18* (2006.01)

(52) U.S. Cl.
CPC ..... *F01D 5/187* (2013.01); *F05D 2240/81* (2013.01); *F05D 2260/201* (2013.01)
USPC ..... 416/96 R; 416/97 R; 415/115

(58) Field of Classification Search
CPC F01D 5/187; F05D 2240/81; F05D 2260/201
USPC ..... 415/115, 116; 416/96 R, 97 R, 193 A
See application file for complete search history.

(56) References Cited

U.S. PATENT DOCUMENTS

| | | | | |
|---|---|---|---|---|
| 6,120,249 | A * | 9/2000 | Hultgren et al. | 416/97 R |
| 6,190,128 | B1 * | 2/2001 | Fukuno et al. | 416/96 R |
| 6,190,130 | B1 * | 2/2001 | Fukue et al. | 416/97 R |
| 6,196,799 | B1 * | 3/2001 | Fukue et al. | 416/97 R |
| 6,419,447 | B1 * | 7/2002 | Watanabe et al. | 415/191 |
| 6,481,967 | B2 * | 11/2002 | Tomita et al. | 416/97 R |
| 6,945,749 | B2 | 9/2005 | De Cardenas | |
| 7,695,247 | B1 * | 4/2010 | Liang | 416/97 R |
| 7,766,606 | B2 | 8/2010 | Liang | |
| 2005/0058545 | A1 * | 3/2005 | Cardenas | 416/97 R |
| 2010/0135772 | A1 * | 6/2010 | Liang | 415/115 |

FOREIGN PATENT DOCUMENTS

| | | | |
|---|---|---|---|
| CN | 1162345 | A | 10/1997 |
| JP | 11-002101 | A | 1/1999 |
| JP | 2001-152804 | A | 6/2001 |
| JP | 2001-271603 | A | 10/2001 |

OTHER PUBLICATIONS

International Search Report of PCT/JP2011/080056, dated of mailing date Dec. 26, 2011.

(Continued)

*Primary Examiner* — Ned Landrum
*Assistant Examiner* — Su Htay
(74) *Attorney, Agent, or Firm* — Westerman, Hattori, Daniels & Adrian, LLP

(57) ABSTRACT

A concave (a relief portion) is formed along a circumferential direction of a rotor in a trailing-edge end surface of a platform. In the trailing-edge end surface disposed outside of the relief portion in the radial direction of the rotor an opening of a cooling channel is provided. The end surface is formed thicker in the radial direction of the rotor at the opening of the cooling channel than at a position corresponding to a trailing-edge end of a hub of an airfoil portion connected to the platform.

7 Claims, 11 Drawing Sheets

(56) References Cited

OTHER PUBLICATIONS

Notification of Transmittal of Translation of the International Preliminary Report on Patentability (Form PCT/IB/326) of International Application No. PCT/JP2011/080056 mailed Dec. 27, 2013 with Forms PCT/IB/373, PCT/IB338 and PCT/ISA/237.

Decision to Grant a Patent dated Jan. 5, 2015, issued in corresponding Japanese Patent Application No. 2013-519345, with English Translation (6 pages).

Office Action dated Oct. 31, 2014, issued in corresponding Chinese Patent Application No. 201180070460.6, with English Translation (14 pages).

Office Action dated Oct. 29, 2014, issued in corresponding Korean Patent Application No. 10-2013-7030827, with English Translation (10 pages).

* cited by examiner

PRIOR ART

PRIOR ART

TURBINE ROTOR BLADE

TECHNICAL FIELD

The present invention relates to a turbine blade provided with a platform in which a cooling channel is formed.

BACKGROUND ART

An aerofoil portion of the turbine blade and the platform are heated to high temperature by high-temperature combustion gas flowing in a gas turbine. This causes the aerofoil portion and the platform to thermally expand outward in a radial direction of a rotor. As the aerofoil portion and the platform thermally expand at different rates, the heat elongation of the aerofoil portion and the platform causes heat stress between a hub of the aerofoil portion and the platform connected to the hub. The heat stress acts intensively on a trailing-edge end of the hub, which tends to cause a crack in the trailing-edge end. Therefore, it is necessary to reduce the heat stress while suppressing the temperature increase in the aerofoil portion and the platform.

JP2001-271603A proposes, as shown in FIG. 10, to provide cooling channels 61 through 64 in the aerofoil portion 12 and the platform 60 and to form a concave 20 in a trailing-edge end part 22 of the platform 60 along a circumferential direction of the rotor (in a direction of passing through a plane of paper of FIG. 10). In the aerofoil portion 12, the cooling channels 61 to 63 are formed along the radial direction of the rotor from a base portion 2 through the aerofoil portion 12. In the platform 60, the cooling channel 64 is formed along the axial direction of the rotor from the trailing-edge end surface 18 to a leading-edge end portion of the platform 60. By streaming cooling air in the aerofoil portion 12 and the platform 60, the temperature increase of the aerofoil portion 12 and the platform 60 is prevented.

Further, in response to the heat elongation of the aerofoil portion 12 expanding outwardly in the radial direction of the rotor, the trailing-edge end surface 18 disposed outside of the concave 20 in the radial direction of the rotor, expands outwardly in the radial direction of the rotor. By this, concentration of the heat stress on the trailing edge end portion 22 of the hub 13 is prevented.

CITATION LIST

Patent Literature

[PTL 1]
JP2001-271603A

SUMMARY OF INVENTION

Technical Problem

According to the method described in JP2001-271603A, the cooling channel of large diameter is formed in the platform 60 along the axial direction of the rotor to improve the cooling effect for the platform 60. However, this requires the trailing-edge end surface 18 disposed outward from the concave 20 in the radial direction of the rotor. By increasing the thickness of the end surface 18, it becomes difficult for the trailing-edge end 22 of the platform 60 to deform, thereby not being able to achieve sufficient reduction of the heat stress. In view of this, instead of increasing the thickness of the end surface 18, the diameter of the cooling channel is increased as show in FIG. 11. In FIG. 11, only an upper half 66 of the cooling channel 65 is formed in the end surface 18 and a lower half is exposed. The cooling air reaching near the trailing-edge end 22 disperses from an opening 67. As a result, the function of cooling the end surface significantly declines.

Therefore, it is an object of the present invention to provide a turbine blade equipped with a platform, which is capable of reducing the heat stress acting between the hub and the platform and also capable of efficiently cooling the platform.

Solution to Problem

To solve the above issues, a turbine blade of the present invention may include, but is not limited to:

a base portion which is fixed to a rotor;

an aerofoil portion which extends in a radial direction of the rotor and which includes a blade surface on a pressure side and a suction side, the blade surface forming an aerofoil profile between a leading ledge and a trailing edge; and a platform which is provided between the base portion and the aerofoil portion and which has a concave formed in a trailing-edge end portion of the platform along a circumferential direction of the rotor and a cooling channel formed inside the platform with an opening to an end surface disposed outward from the concave in a radial direction of the rotor, and the end surface may be formed thicker in the radial direction of the rotor at the opening of the cooling channel opening to the end surface than at a position which corresponds to a trailing-edge end of a hub of the aerofoil portion at which the aerofoil portion is connected to the platform.

According to the above turbine blade, the end surface may be formed thinner at a portion corresponding to the trailing-edge end of the hub of the aerofoil portion than other portions of the end surface. Thus, the portion near the trailing-edge end portion of the platform where the trailing-edge end of the hub is connected can deform easily in response to the heat elongation of the aerofoil portion and thus, it is possible to suppress the heat stress generated near the trailing-edge end portion of the platform.

Further, it is possible to form the cooling channel having a large diameter. As a result, the cooling performance for the platform is enhanced and it becomes possible to apply the present invention to the turbine used under high temperature.

In the above turbine blade, the end surface of the platform on a trailing edge side may gradually decrease in a thickness of the end surface in the radial direction of the rotor from the suction side of the aerofoil portion toward the trailing-edge end of the hub.

In this manner, the end surface of the platform on the trailing edge side gradually decreases in a thickness of the end surface in the radial direction of the rotor from the suction side of the aerofoil portion toward the trailing-edge end of the hub and the end surface of the platform is formed thickest on the trailing edge side. As a result, the cooling channel can be formed along the axial direction of the rotor on the suction side, thereby improving the cooling performance for the platform on the suction side.

In the above turbine blade, a plurality of the cooling channels may be formed in the platform along the axial direction of the rotor next to each other, and among the plurality of the cooling channels, a cooling channel that is arranged on the pressure side of the aerofoil portion may have a smaller diameter than a cooling channel that is arranged on the suction side of the aerofoil portion.

In this manner, among the plurality of the cooling channels formed next to each other, a cooling channel that is arranged on the pressure side of the aerofoil portion may have a smaller diameter than a cooling channel that is arranged on the suction side of the aerofoil portion. As a result, a plurality of the cooling channels can be formed in the platform.

Further, by forming a plurality of the cooling channels in the platform, the cooling effect of the platform can be significantly improved.

In the above turbine blade, the thickness of the end surface of the platform on the trailing edge side may gradually decrease in the end surface in the radial direction of the rotor from the suction side of the aerofoil portion toward the trailing-edge end of the hub and from the pressure side of the aerofoil portion toward the trailing-edge end of the hub.

In this manner, the thickness of the end surface of the platform on the trailing edge side gradually decreases in the end surface in the radial direction of the rotor from the suction side of the aerofoil portion toward the trailing-edge end of the hub and from the pressure side of the aerofoil portion toward the trailing-edge end of the hub. As a result, the cooling channels having a large diameter can be formed on both sides of the trailing edge end of the hub in the circumferential direction of the rotor. By this, the cooling effect for the platform can be significantly improved.

In the above turbine blade, a plurality of the cooling channels may be formed in the platform along the axial direction of the rotor next to each other, and among the plurality of the cooling channels, a cooling channel that is arranged closer to the trailing-edge end of the hub may have a smaller diameter than a cooling channel that is arranged farther from the trailing-edge end of the hub.

In this manner, among the plurality of the cooling channels formed next to each other, a cooling channel that is arranged closer to the trailing-edge end of the hub has a smaller diameter than a cooling channel that is arranged farther from the trailing-edge end of the hub. As a result, a plurality of the cooling channels can be formed in the platform.

Further, by forming a plurality of the cooling channels in the platform, the cooling effect for the platform can be significantly improved.

In the above turbine blade, the plurality of the cooling channels may include a cooling channel which is formed in the trailing-edge end portion of the platform along a shape of a trailing edge side of the blade surface on the suction side.

In this manner, the cooling channel is formed in the trailing-edge end portion of the platform along a shape of a trailing edge side of the blade surface on the suction side. As a result, it is possible to positively cool the trailing-edge end portion of the platform.

Advantageous Effects of Invention

According to the present invention, it is possible to efficiently cool the platform and to reduce stress acting between the hub and the platform.

DESCRIPTION OF EMBODIMENTS

Embodiments of a turbine blade regarding the present invention will now be described in detail with reference to the accompanying drawings. In the detailed explanation, the turbine blade is applied to a gas turbine. However, this is not limitative and the present invention can be applied to a steam turbine as well. Further, it is intended that unless particularly specified, dimensions, materials, shape, its relative positions and the like shall be interpreted as illustrative only and not limitative of the scope of the present invention.

Figure 1:
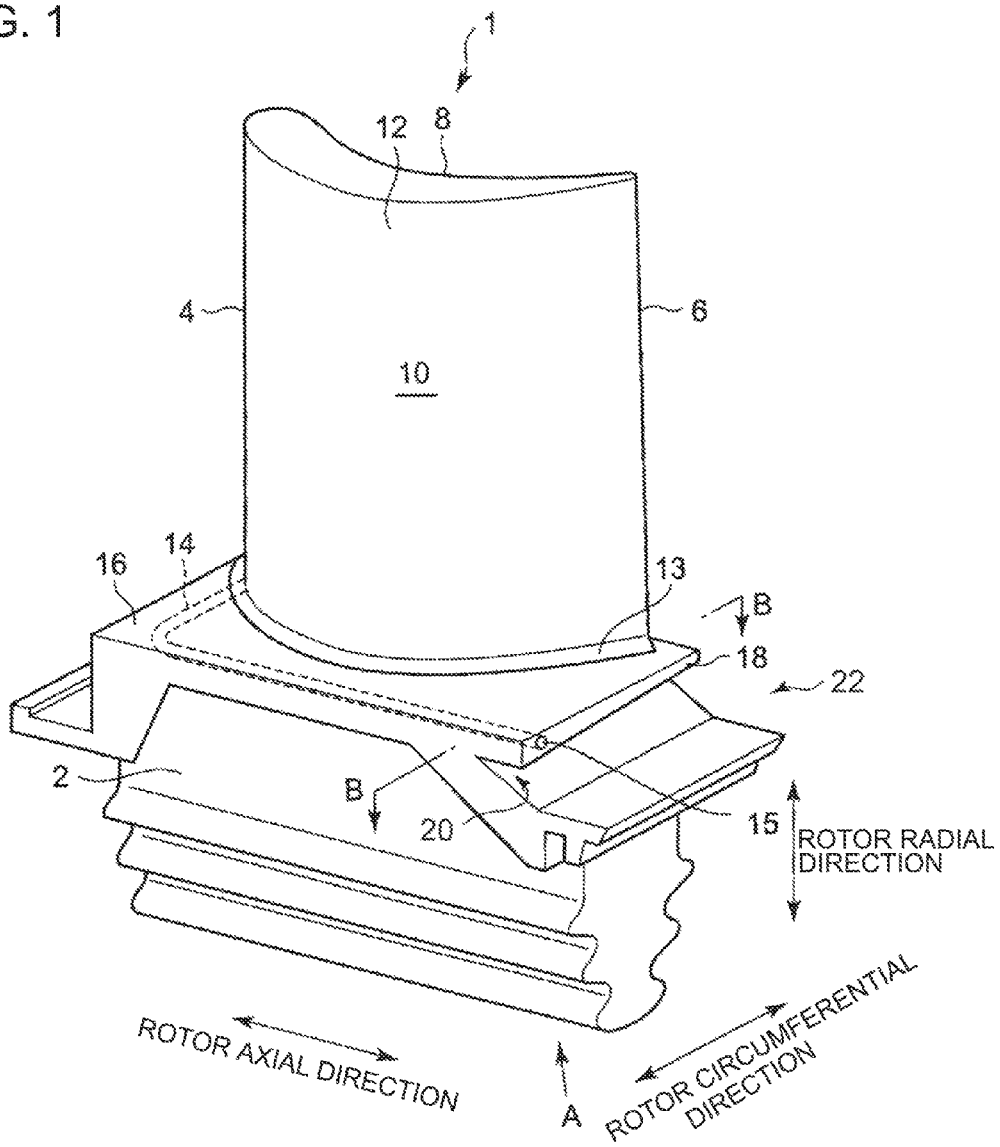
FIG. 1 is an oblique perspective view of a turbine blade regarding a first embodiment of the present invention.
Figure 2:
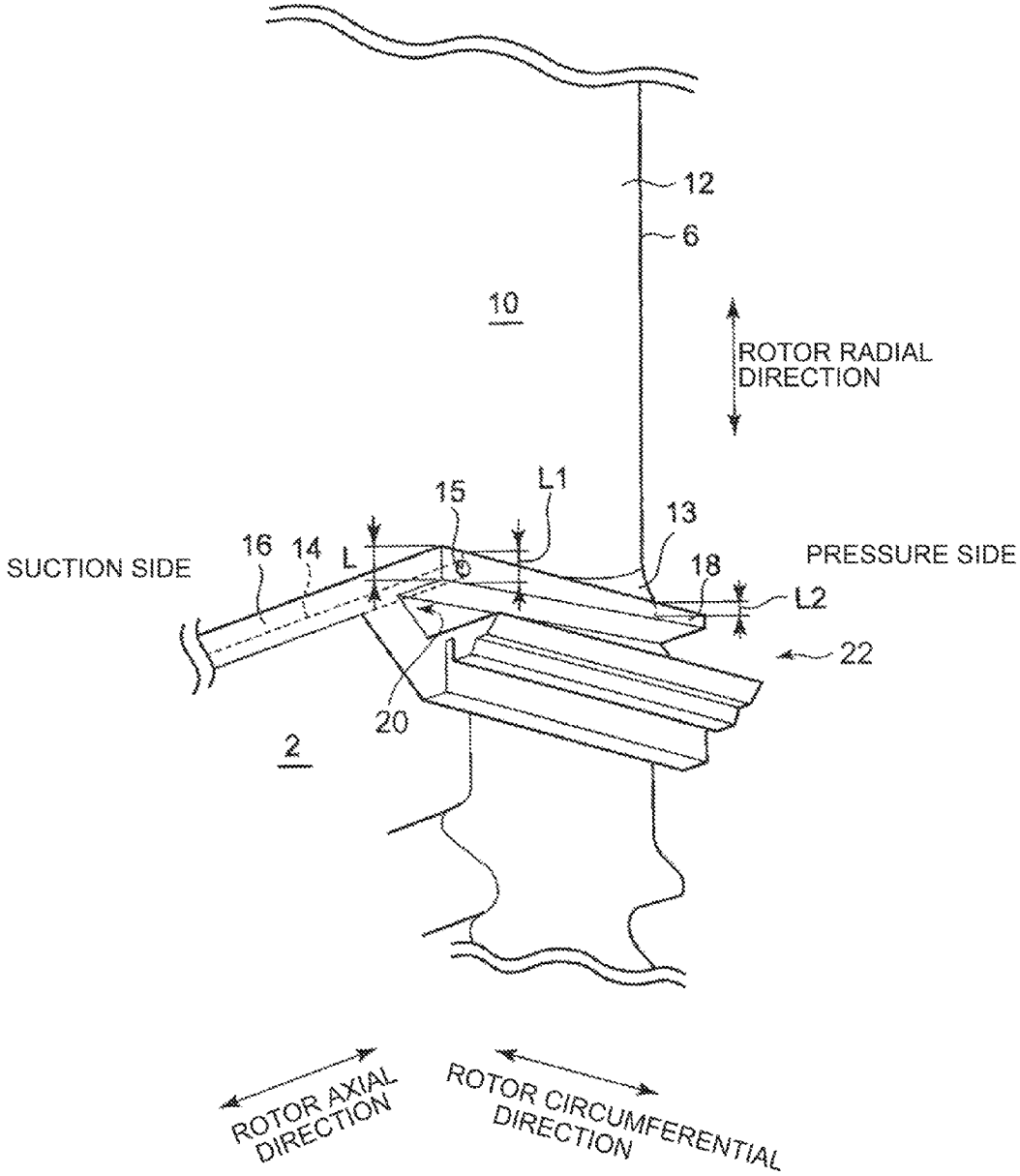
FIG. 2 is a fragmentary view taken in a direction of an arrow A of FIG. 1, showing an enlarged view around a trailing-edge end portion of a platform.

FIG. 1 is an oblique perspective view of a turbine blade regarding a first embodiment of the present invention. FIG. 2 is a fragmentary view taken in a direction of an arrow A of FIG. 1, showing an enlarged view around a trailing-edge end portion of a platform.

As shown in FIG. 1 and FIG. 2, in the first embodiment of the present invention, a cooling channel 14 is formed in the platform 16 on a suction side of an aerofoil portion 12 to reduce heat stress of the platform on the suction side.

The turbine blade 1 of the gas turbine includes a base portion 2 fixed to a rotor, the aerofoil portion 12 extending in a radial direction of the rotor and including a blade surface 8 on a pressure side and the suction side between a leading edge 4 and a trailing edge 6, and the platform 16 provided between the base portion 2 and the aerofoil portion 12 and having the cooling channel 14 for streaming cooling air.

At a trailing-edge end portion 22 of the platform, a concave 20 is formed along the circumferential direction of the rotor. The concave 20 is a so-called relief portion. The cooling channel 14 has an opening 15 opening to a trailing-edge end surface 18 disposed outward from the concave 20 in the radial direction of the rotor.

The thickness L of the trailing-edge end surface 18 in the radial direction of the rotor gradually decreases from the suction side of the aerofoil portion 12 toward the trailing-edge end of the hub. In other words, the thickness L of the end surface 18 in the radial direction of the rotor decrease gradually from L1 near the opening 15 of the cooling channel 14 to L2 immediately below the trailing-edge end of the hub 13.

In the embodiment, there is no cooling channel provided on the pressure side in the platform 16 along the axial direction of the rotor. Thus, the end surface 18 may be formed thinner or with the same thickness between immediately below the trailing edge end of the hub 13 and an end on the pressure side.

Figure 11:
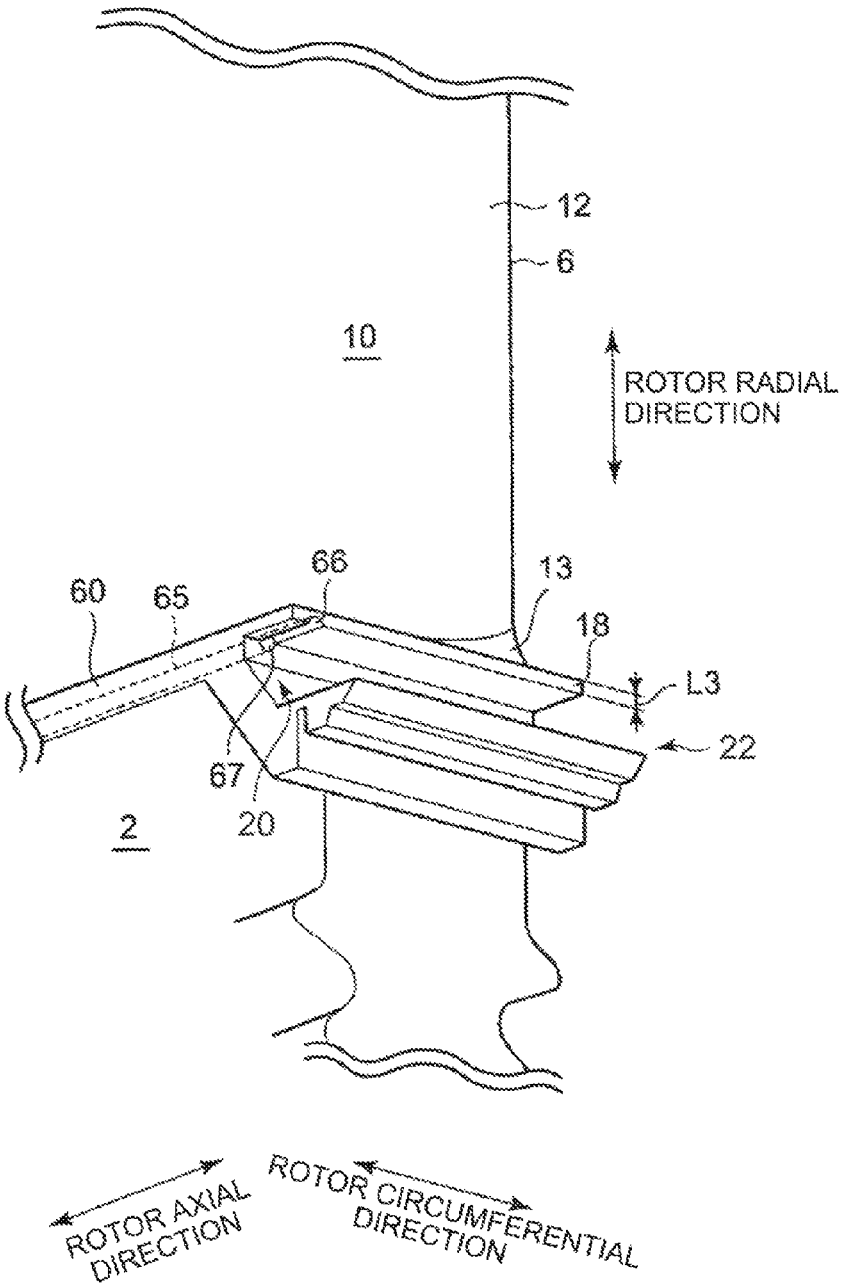
FIG. 11 is an oblique perspective view showing a trailing-edge end portion of the platform.

The thickness L2 of the end surface 18 immediately below a connection point where the trailing-edge end of the hub 13 is connected to the platform 16 in the circumferential direction of the rotor, is deformable in response to heat elongation of the aerofoil portion 12. This is substantially the same as the thickness L3 of the end surface 18 of the conventional platform 60 described in JP2001-271603A (see FIG. 11). Thus, the thickness L1 of the end surface 18 at the opening 15 of the cooling channel 14 formed along the axial direction of the rotor is greater than the thickness L3 of the end surface 18 of the conventional platform 60 of JP2001-271603A. By this, the cooling channel 14 can have an opening of a greater diameter than the cooling channel 64 formed in the conventional platform 60.

Figure 3:
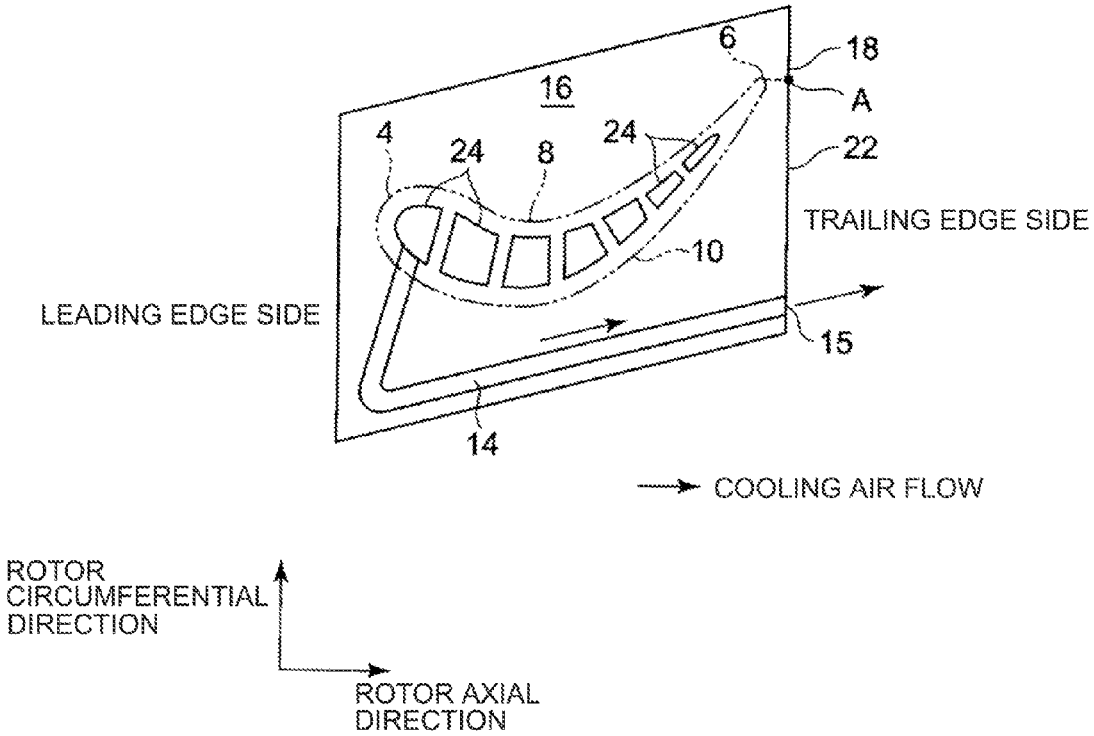
FIG. 3 is a cross-sectional view taken along a line B-B of FIG. 1.

FIG. 3 is a cross-sectional view taken along a line B-B of FIG. 1. As shown in FIG. 3, one end of the cooling channel 14 communicates with a cooling channel 24 on the leading edge side. The cooling channel 24 is in communication with the base portion 2 and the aerofoil portion 12 of the turbine blade 1. Further, the cooling channel 14 extends from the cooling channel 24 toward a front lower end of the platform 16 (left bottom in FIG. 3), and bends near the front lower end of the platform toward the trailing edge side and extends along the axial direction of the rotor.

A portion of the cooling air flowing in the cooling channel 24 enters the cooling channel 14. The cooling air having entered the cooling channel 14 flows through the cooling channel 14 and exits from the opening 15 on the trailing edge side.

At a position where the hub 13 comes closest to the end surface 18 on the trailing edge side, a binding force from the platform having high rigidity is large and thus, the heat stress acting on the aerofoil portion 12 and the hub tends to increase near the trailing edge. Therefore, to reduce the heat stress, the concave 20 (the relief portion) is formed in the trailing-edge end portion 22. In other words, the position where the hub 13 comes closest to the end surface 18 on the trailing edge side, is immediately below the connection point where the trailing-edge end of the hub is connected to the platform 16. It is necessary to release the binding from platform side in the vicinity of the connection point. Specifically, as shown in FIG. 3, a point A is described at the end surface by drawing a line parallel with the axial direction of the rotor from a trailing edge 6. In a vicinity of the point A, the hub 13 comes closest to the end surface 18 on the trailing edge side. In other words, when the trailing-edge end surface 18 of the platform 16 on the suction side and the pressure side has the opening 15 of the cooling channel 14 formed along the axial direction of the rotor, it is necessary to form the end surface 18 the thinnest in the radial direction of the rotor near the point A so as to achieve high relief effect.

Figure 4:
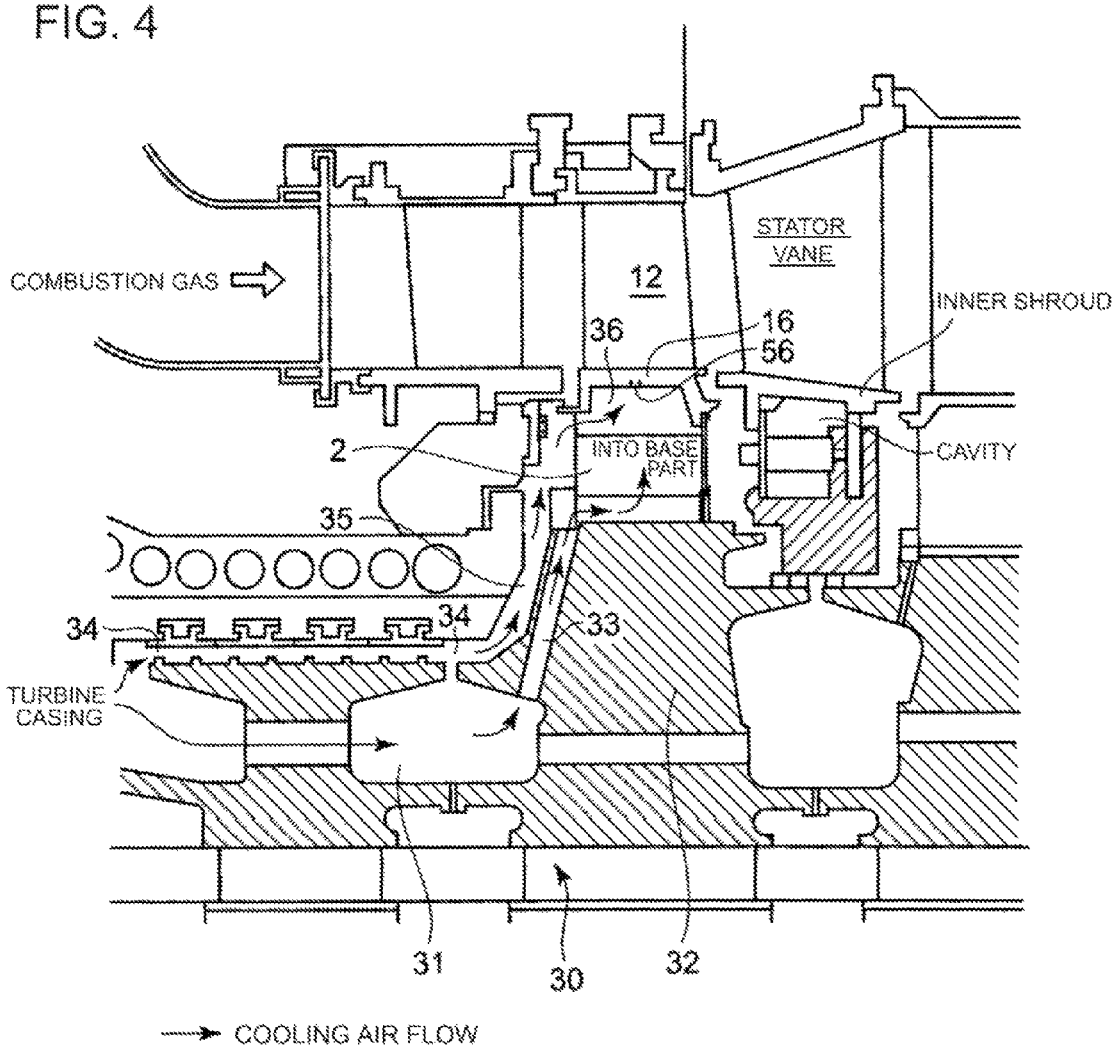
FIG. 4 is a cross-sectional view of a gas turbine, showing a flow of cooling air near the turbine blade.

FIG. 4 is a cross-sectional view of a gas turbine, showing a flow of the cooling air near the turbine blade 1.

As shown in FIG. 4, the cooling air supplied from a turbine casing enters a disc cavity 31 in the rotor 30, passes through a radial hole 33 formed in a rotor disc 32 to the cooling channel 24 formed in the base portion 2. On the way to the aerofoil portion 12, a portion of the cooling air enters the cooling channel 14 formed in the platform 16.

A supply system for supplying the cooing air to the cooling channel 14 may not be limited by this and another system may be used.

As described above, according to the turbine blade of the present embodiment, the thickness L (L1) at the opening 15 of the cooling channel 14 of the end surface 18 of the platform 16 in the radial direction of the rotor is greater than at the position immediately below the trailing edge end of the hub 13 of the aerofoil portion 12, L2 (near the point A of FIG. 3). By this, it is possible to enhance the cooling capacity for the platform 16.

On the other hand, the thickness L2 of the end surface 18 immediately below the trailing-edge end of the hub 13 is smaller than the thickness L1 of the end surface at the opening 15 of the cooling channel 14. Thus, a portion of the end surface 18 near the connection point of the trailing-edge end of the hub 13 can deform easily in response to the heat elongation of the aerofoil portion 12, and it is possible to suppress the heat stress generated near the trailing-edge end portion 22 of the platform 16.

Further, it is now possible to form the cooling channel 14 having a large diameter in the platform 16 on the suction side of the aerofoil portion 12. As a result, the cooling capacity for the platform is improved, making it applicable to the turbine used at high temperature.

The end surface 18 gradually decreases in a thickness L of the end surface 18 in the radial direction of the rotor from the suction side of the aerofoil portion 12 toward the trailing-edge end of the hub 13, thereby improving the cooling capacity for the platform 16 on the suction side of the aerofoil portion 12 which is under high heat load. It is easy to process the end surface 18 so as to gradually reduce the thickness L of the end surface 18 in the radial direction of the rotor from the suction side of the aerofoil portion 12 toward the trailing-edge end of the hub 13 without increase in labor hours or the cost.

Figure 5:
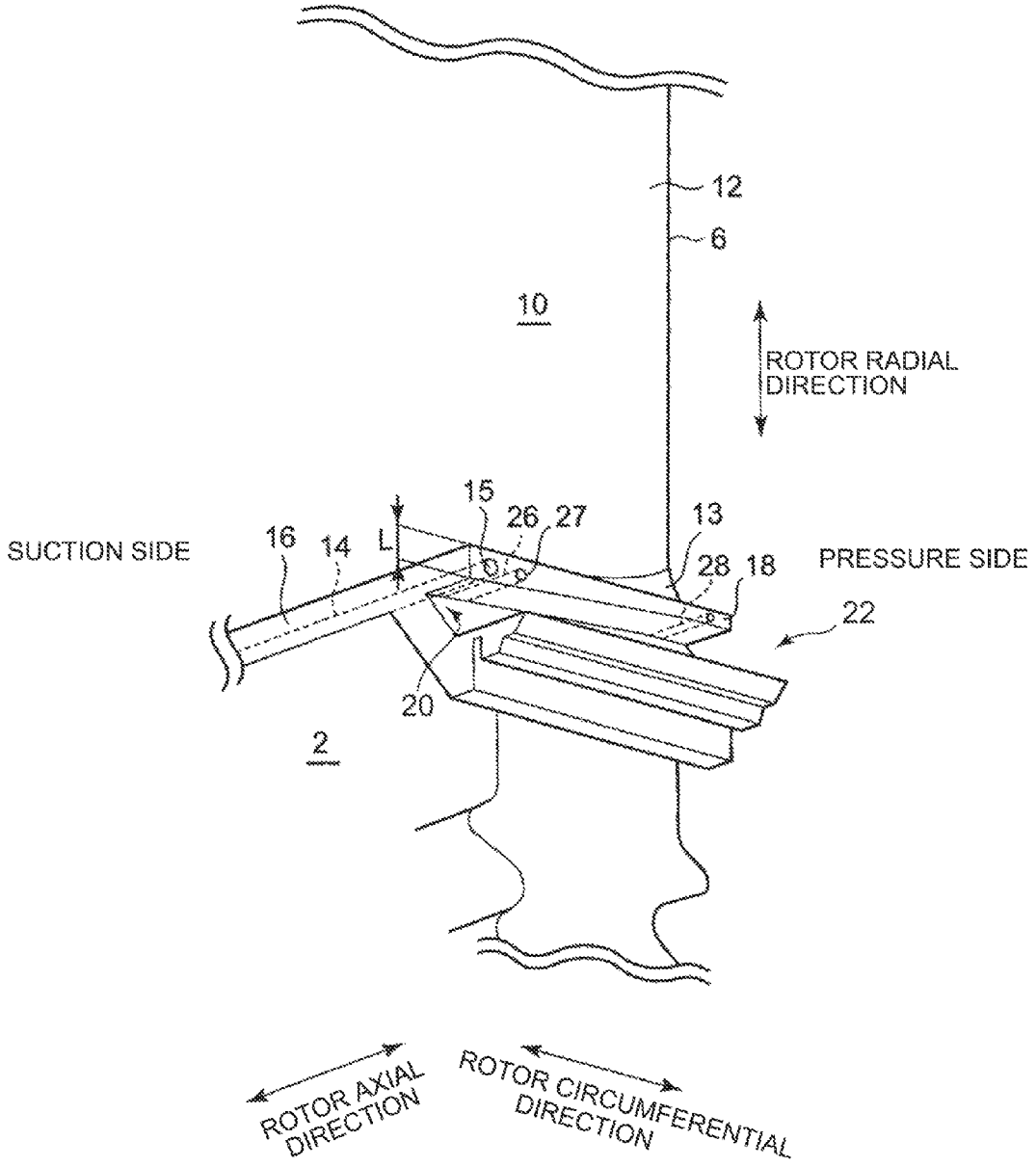
FIG. 5 is another example of the cooling channel formed in the platform.
Figure 6:
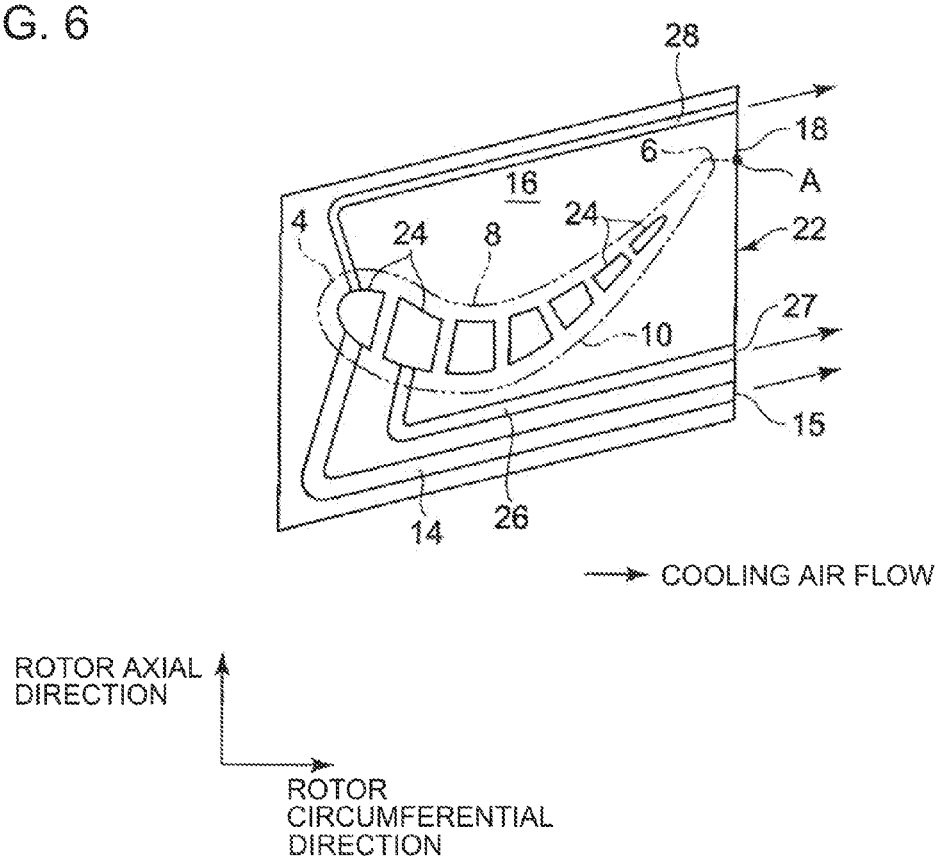
FIG. 6 is yet another example of the cooling channel formed in the platform.

In the above embodiment, one cooling channel 14 is formed on the suction side of the aerofoil portion 12. This is, however, not limitative and the number or the size of the opening of the cooling channel 14 may be freely determined depending on the heat load of the platform and the generated heat stress. For instance, as shown in FIG. 5 and FIG. 6, the thickness L of the end surface 18 may be constant between immediately below the trailing-edge end of the hub 13 and the pressure-side end which is the end of the end surface 18 on the pressure side of the aerofoil portion 12, and a plurality of cooling channels 14 and 26 may be formed on the suction side of the aerofoil portion 12 and a cooling channel 28 may be formed on the pressure side of the aerofoil portion 12. In this case, the openings of the cooling channels 14, 26, 28 may decrease in the diameters of the openings gradually from the suction side to the pressure side of the aerofoil portion 12.

In this manner, by making the diameters of the cooling channels 26 and 28 smaller than that of the cooling channel 14, it is still possible to form the cooling channels 26 and 28 even where the thickness L of the end surface 18 in the radial direction of the rotor is small.

By forming a plurality of the cooling channels 14, 26 and 28 in the platform 16, it is possible to significantly enhance the cooling effect for the platform.

Other embodiments of the turbine blade 1 are explained hereinafter. In the following embodiments, components already described in the first embodiment are denoted by the same reference numerals, and thus detailed description thereof will be hereinafter omitted and mainly the differences are explained.

Figure 7:
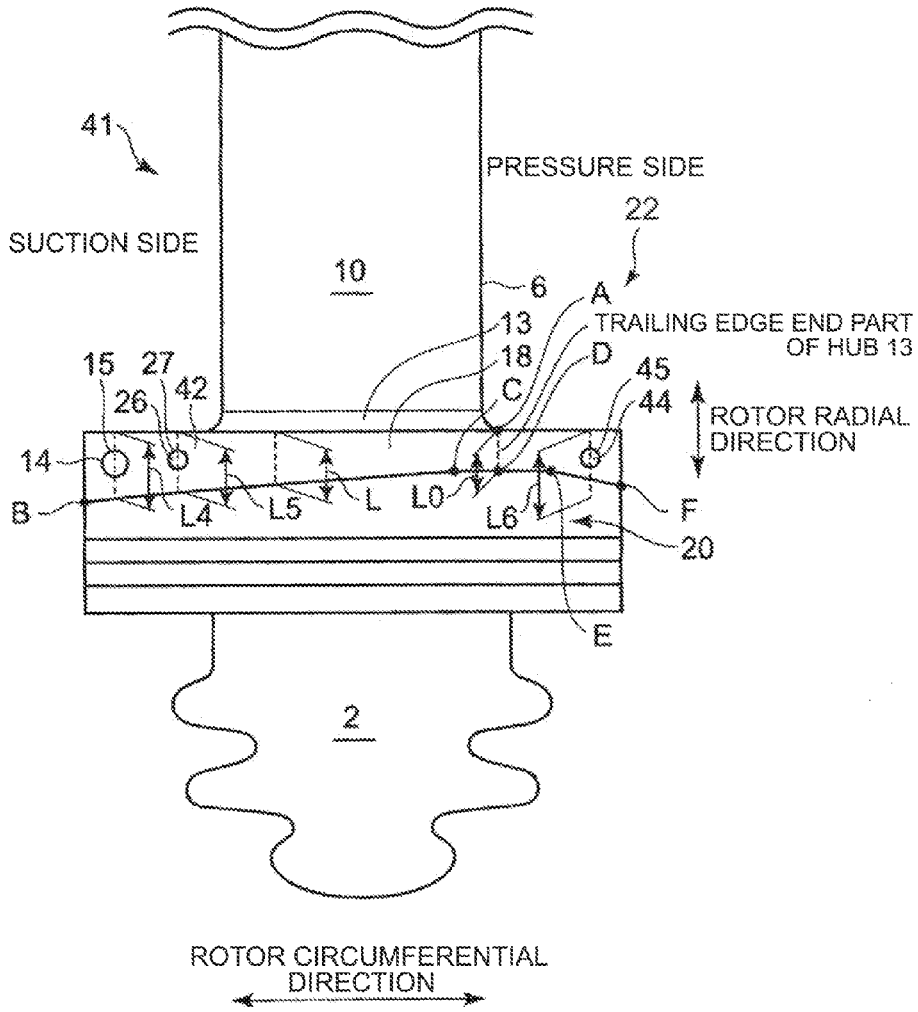
FIG. 7 is a perspective view of the turbine blade taken from a trailing edge side in relation to a second embodiment of the present invention.

FIG. 7 is a perspective view of a turbine blade 41 taken from the trailing edge side in relation to a second embodiment of the present invention.

As shown in FIG. 7, to reduce the heat stress of the platform on both the suction side and the pressure side, the cooling channels 14, 26 and 44 are formed in a platform 42 on both the suction side and the pressure side. The shape of the concave 20 (the relief portion) is modified in correspondence to the positions of the cooling channels 14, 26 and 44.

In the platform 42 of the turbine blade 41, a plurality of the cooling channels 14, 26 and 44 are formed. And, the openings 15, 27 and 45 of the cooling channels 14, 26 and 44 respectively are formed in the trailing-edge end surface 18. Specifically, the openings 15 and 27 corresponding to the cooling channels 14 and 26 are formed in the end surface 18 on the suction side and the opening 45 corresponding to the cooling channel 44 is formed in the end surface 18 on the pressure side.

FIG. 7 shows one example of the shape of the concave (the relief portion) 20 formed in correspondence to the positions of the cooling channels 14, 26 and 44. The position immediately below the connection point where the trailing-edge end of the hub 13 is connected to the platform, is indicated as the point A. The lower point of the trailing-edge end at the position is indicated as a point D. In this manner, the shape of the concave 20 is determined by a line B-C-D-E-F. In other words, the concave 20 is formed into a mountain-shape as a whole with the point D at the top such that the a ceiling portion is formed by a linear line C-D-E having a constant height L0 in the radial direction of the rotor, the point D being in middle and by gradual slopes formed on both sides of the linear line toward the suction-side end and the trailing-edge end.

In the case of the concave 20 having the shape described above, the thickness L of the end surface 18 in the radial direction of the rotor is the smallest at the position with the thickness L0 (between the points A and D) immediately below the connection point where the trailing-edge end of the hub 13 is connected to the platform 16 In other words, the thickness L4, L5, L6 of the end surface 18 at each of the openings 15, 27 and 45 of the cooling channels 14, 26 and 44 respectively formed along the axial direction of the rotor is greater than the thickness L0 immediately below the connection point of the trailing-edge end of the hub 13 in the circumferential direction of the rotor.

In the second embodiment, the thickness L0 of the end surface 18 immediately below the connection point of the trailing edge end of the hub 13 is approximately the same as the thickness L3 of the end surface 18 of the conventional platform 60 described in JP2001-271603A. This is the same as the first embodiment. The thickness L4, L5 and L6 at the openings 15, 27 and 45 of the cooling channels 14, 26 and 44 respectively disposed in the circumferential direction of the rotor are greater than the thickness L3 of the end surface 18 of the conventional platform 60. Thus, it is possible to form the cooling channels 14, 26 and 44 whose diameters are greater than that of the cooling channel formed in the conventional platform 60.

As described above, according to the turbine blade 41 of the present invention, in addition to the effects achieved in the first embodiment, it is possible to significantly enhance the cooling effect for the platform 16 by providing the cooling channels 14, 27 and 44 whose diameters are greater than that of the cooling channel formed in the conventional platform 60.

Next, a third embodiment of the turbine blade is explained. The third embodiment of the present invention is different from the first embodiment in that a cooling channel 54 is further provided. The cooling channel 54 is formed in the platform 16 along a shape of the trailing edge side of the blade surface 8 on the suction side of the aerofoil portion 12.

Figure 8:
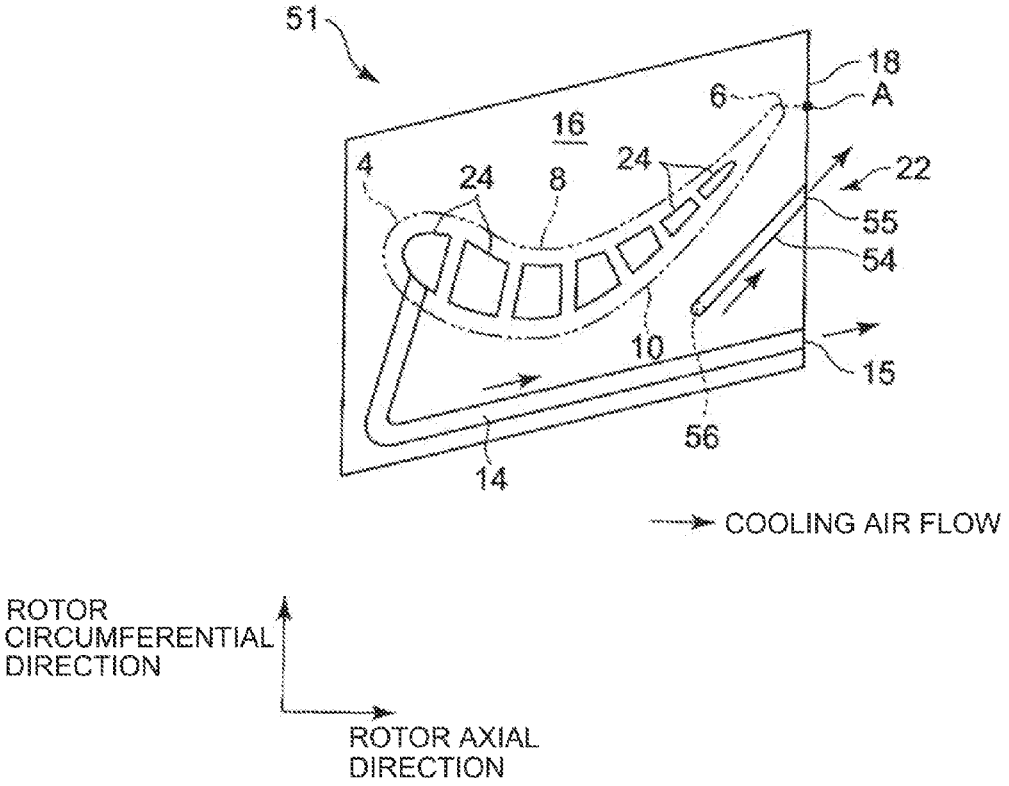
FIG. 8 is a cross-sectional view of the platform regarding a third embodiment of the present invention.

FIG. 8 is a cross-sectional view of the platform regarding a third embodiment of the present invention.

As shown in FIG. 8, the cooling channel 54 is formed in the platform 16 on the suction side of the aerofoil portion 12 along a shape of the trailing edge side of the blade surface 10.

The cooling channel 54 has an opening 55 at one end and another opening 56 at the other end. The opening 55 opens to the trailing-edge end surface 18 of the platform 16. The cooling channel 54 has a diameter smaller than that of the cooling channel 14. The opening 56 opens to a surface of the platform 16 which is on the base portion side.

The flow of the cooling air from the rotor 30 to the cooling channel 54 is now explained.

As shown in FIG. 4, the cooling air passes through a seal disk 34 and a disc cavity 35 that are formed in the rotor 30 and enters a platform cavity 36. Then, the cooling air enters the cooling channel 54 from the opening 56 formed on the surface of the platform 16 on the base portion side. The cooling air having entered the cooling channel 54 cools the platform 16 and then exits from the opening 55 on the trailing edge side.

The supply system for supplying the cooing air may not be limited by this and another system may be used. For instance, the other end of the cooling channel 54 may be connected to the cooling channel 24 which communicates with the aerofoil portion 12 to branch from the cooling channel 24. The cooling channel 24 is already described in the first embodiment.

Further, in third embodiment, the cooling channel 54 is formed in the platform 16 of the first embodiment. However, this is not limitative and the cooling channel 54 is applicable to the platform 42 of the second embodiment as well.

As described above, according to the turbine blade 51 of the third embodiment, in addition to the effects achieved in the first and second embodiments, by providing the cooling channel 54, it is possible to significantly improve the cooling capacity for the trailing-edge end portion 22 of the platform 16.

A turbine blade of a fourth embodiment of the present invention is explained in reference to FIG. 8. The fourth embodiment of the present invention is substantially the same as the first embodiment except that the thickness of the end surface 18 of the platform 16 in the radial direction of the rotor is different from that of the first embodiment.

Figure 9:
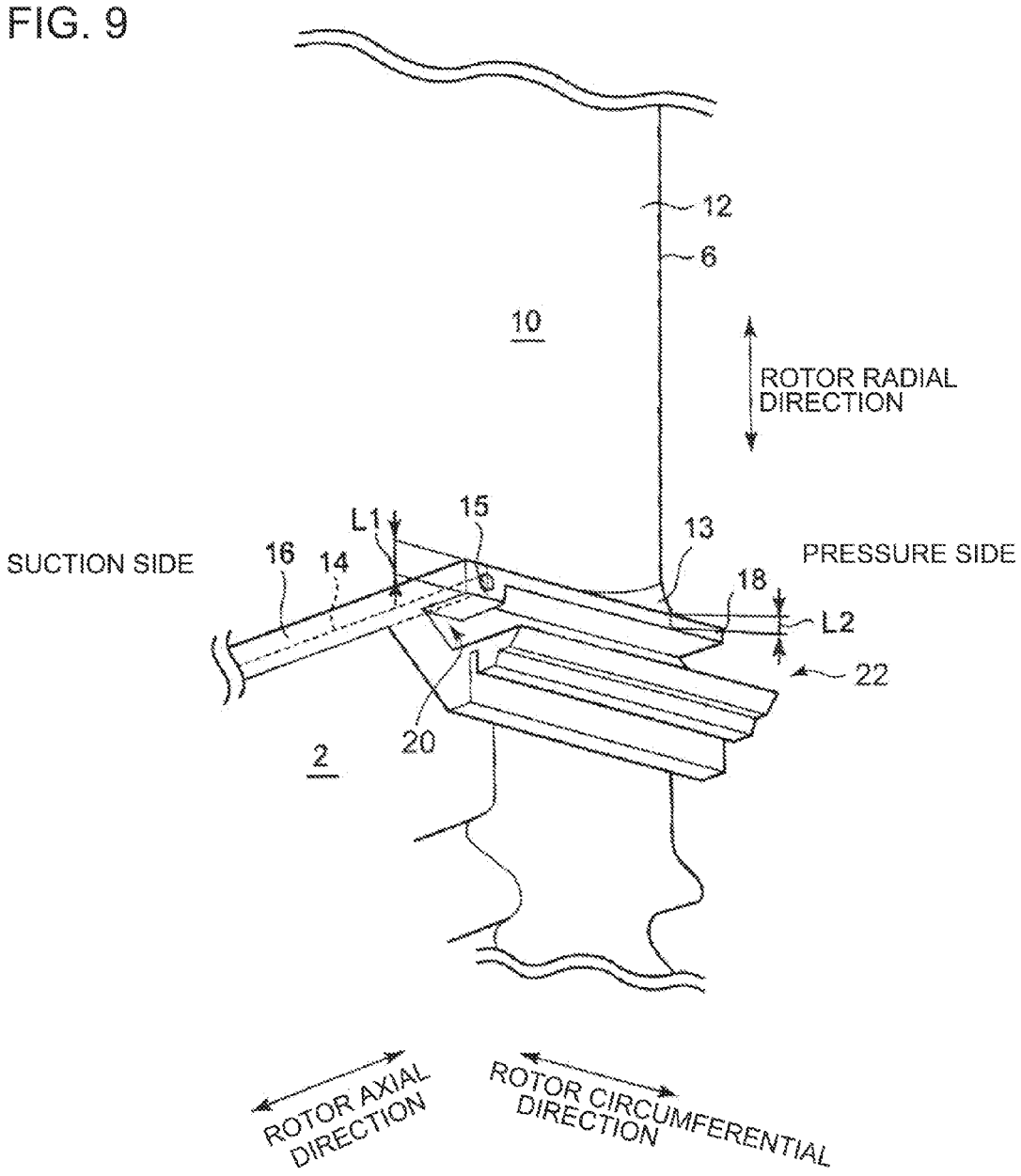
FIG. 9 is a perspective view of the turbine blade taken from a trailing edge side in relation to a fourth embodiment of the present invention.
Figure 10:
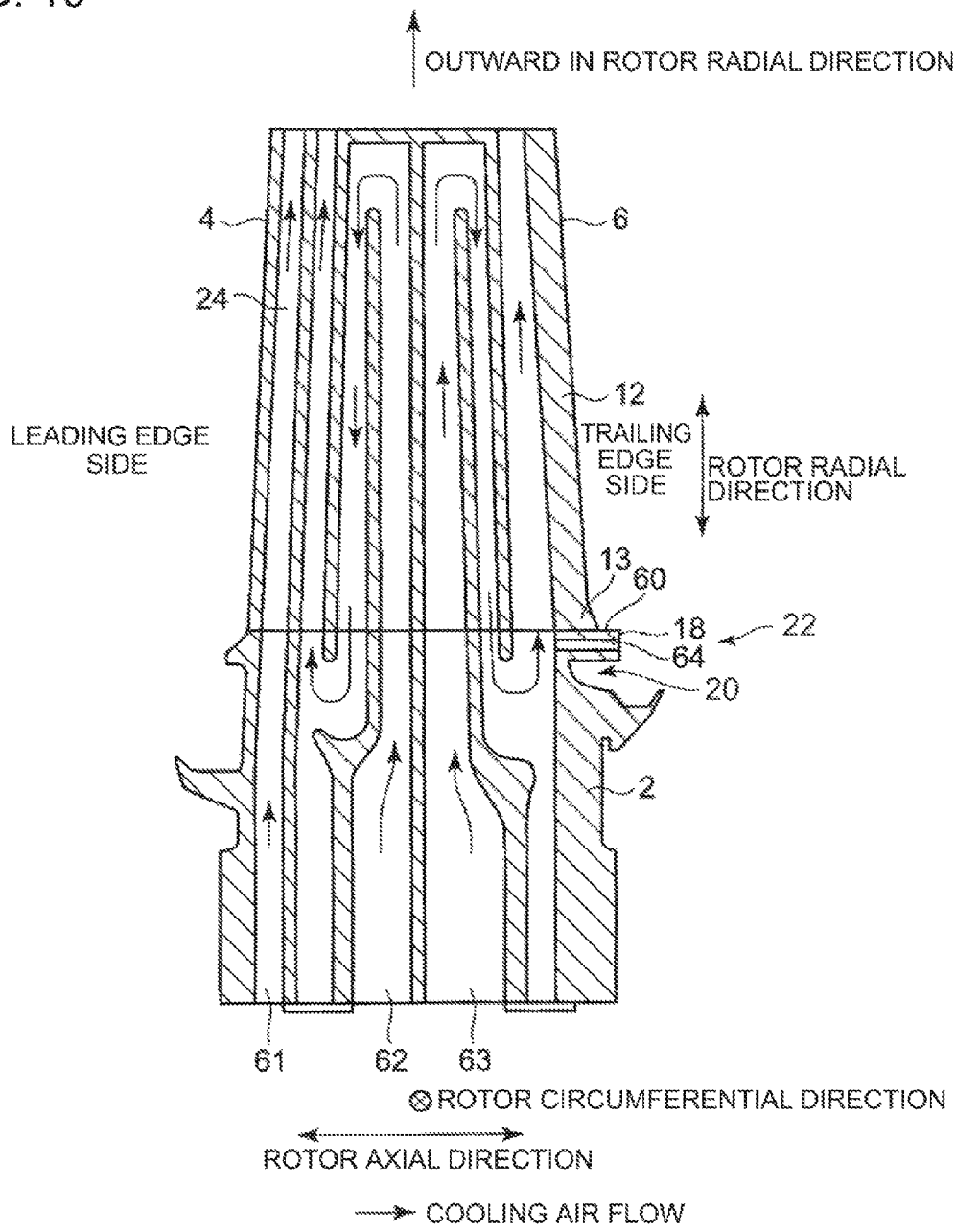
FIG. 10 is a vertical cross-sectional view of a conventional turbine blade.

As shown in FIG. 9, in the fourth embodiment, the end surface 18 of the platform 16 changes the thickness in the radial direction of the rotor. Specifically, the end surface 18 may be formed with the thickness L1 near the opening 15 of the cooling channel formed in the platform 16 on the suction side along the axial direction of the rotor so that the opening 15 can be arranged, and with the constant thickness L2 past the thickness L1 through immediately below the trailing-edge end to the suction-side end such that the thickness L2 is smaller than the thickness L2. According to the fourth embodiment, the same operations and effects as the first embodiment can be achieved.

The invention claimed is:

1. A turbine blade comprising:

a base portion which is fixed to a rotor;

an aerofoil portion which extends in a radial direction of the rotor and which includes a blade surface on a pressure side and a suction side, the blade surface on the pressure side and the suction side forming an aerofoil profile between a leading edge and a trailing edge; and a platform which is provided between the base portion and the aerofoil portion, and which has a concave formed in a trailing-edge end portion of the platform along a circumferential direction of the rotor and a cooling channel formed inside the platform with an opening to an end surface of the trailing-edge end portion disposed outward from the concave in the radial direction of the rotor, wherein a thickness of the end surface constantly decreases in the radial direction of the rotor from an edge of the platform on the suction side of the aerofoil portion toward the trailing-edge end of a connecting portion between the aerofoil portion and the platform, where the edge of the platform on the suction side is an outermost edge of the platform on the suction side, the outermost edge extending along an axial direction of the rotor.

2. The turbine blade according to claim 1, wherein a plurality of the cooling channels are formed in the platform along the axial direction of the rotor next to each other, and wherein one of the plurality of the cooling channels that is arranged on the pressure side of the aerofoil portion has a smaller diameter than at least another one of the plurality of the cooling channels that is arranged on the suction side of the aerofoil portion.

3. The turbine blade according to claim 1, wherein the end surface gradually decreases in a thickness in the radial direction of the rotor from an edge of the platform on the pressure side of the aerofoil portion toward the trailing-edge end of the connecting portion.

4. The turbine blade according to claim 1 or 3, wherein a plurality of the cooling channels are formed in the platform along the axial direction of the rotor next to each other, and wherein one of the plurality of the cooling channels that is arranged closer to the trailing-edge end of the connecting portion has a smaller diameter than at least another one of the plurality of the cooling channels that is arranged farther from the trailing-edge end of the connecting portion.

5. The turbine blade according to claim 1, wherein a plurality of the cooling channels includes a cooling channel which is formed in the trailing-edge end portion of the platform along a shape of a trailing edge side of the blade surface on the suction side.

6. The turbine blade according to claim 4, wherein the plurality of the cooling channels includes a cooling channel which is formed in the trailing-edge end portion of the platform along a shape of a trailing edge side of the blade surface on the suction side.

7. A turbine blade comprising:

a base portion which is fixed to a rotor;

an aerofoil portion which extends in a radial direction of the rotor and which includes a blade surface on a pressure side and a suction side, the blade surface on the pressure side and a suction side forming an aerofoil profile between a leading edge and a trailing edge; and a platform which is provided between the base portion and the aerofoil portion, and which has a concave formed in a trailing-edge end portion of the platform along a circumferential direction of the rotor and a cooling channel formed inside the platform with an opening to an end surface of the trailing-edge end portion disposed outward from the concave in the radial direction of the rotor, wherein the platform extends along the circumferential direction over an entire width of the platform from a first edge of the platform on the suction side to a second edge of the platform on the pressure side, and wherein a thickness of the end surface constantly decreases in the radial direction of the rotor from the first edge of the platform on the suction side toward the trailing-edge end of a connecting portion between the aerofoil and the platform.

* * * * *